US007509790B1

(12) United States Patent
Filep

(10) Patent No.: US 7,509,790 B1
(45) Date of Patent: Mar. 31, 2009

(54) RANDOM CASE FORMER

(75) Inventor: Zoltan Filep, 360 E. Evelyn Ave #320, Sunnyvale, CA (US) 94086

(73) Assignee: Zoltan Filep, Sunnyvale, CA (US)

( * ) Notice: Subject to any disclaimer, the term of this patent is extended or adjusted under 35 U.S.C. 154(b) by 0 days.

(21) Appl. No.: 11/599,040

(22) Filed: Nov. 13, 2006

Related U.S. Application Data

(60) Provisional application No. 60/736,469, filed on Nov. 13, 2005.

(51) Int. Cl.
*B65B 43/26* (2006.01)

(52) U.S. Cl. ..... 53/564; 53/376.4; 493/70; 493/80; 493/183

(58) Field of Classification Search ..... 493/70, 493/80, 151, 180, 183; 53/458, 564, 566, 53/376.4, 382.2, 382.3
See application file for complete search history.

(56) References Cited

U.S. PATENT DOCUMENTS 2,977,861 A * 4/1961 Gibb ..... 493/171
3,242,635 A * 3/1966 Kobick ..... 53/222
3,982,474 A * 9/1976 Klund ..... 493/18
4,589,862 A * 5/1986 Murrah ..... 493/183
4,982,552 A * 1/1991 Odenthal ..... 53/207
5,102,382 A * 4/1992 Center et al. ..... 493/1
5,511,362 A * 4/1996 Morita et al. ..... 53/491
5,632,713 A * 5/1997 Canning et al. ..... 493/162
5,879,480 A * 3/1999 Hetzner ..... 148/644
5,957,825 A * 9/1999 Marchetti ..... 493/313
6,226,965 B1 * 5/2001 Lam ..... 53/491
6,319,183 B1 * 11/2001 Ballos, III ..... 493/37
6,669,616 B1 * 12/2003 Bierenacki et al. ..... 493/316

* cited by examiner

*Primary Examiner*—Hemant M Desai
(74) *Attorney, Agent, or Firm*—James E. Eakin

(57) ABSTRACT

A random case former accepts an opened-up flat corrugated material representing an unformed box with open bottoms and tops. The random case former automatically adjusts to the dimensions of the box by closing in on the unformed box with flap folders from one or more sides. As the flap folders close in on the box, they first fold the minor-flaps and then the major-flaps on the bottom of the unformed box, thereby forming a box with a closed bottom and an open top into which items can then be placed. The automatic adjustment of the random case former to the box size avoids time-consuming manual adjustment and provides efficiency and speed.

16 Claims, 11 Drawing Sheets

RANDOM CASE FORMER

CROSS REFERENCE TO RELATED APPLICATIONS

This application claims priority to U.S. Provisional Patent Application No. 60/736,469 filed on Nov. 13, 2005.

BACKGROUND

1. Field

Invention relates generally to packaging, and in particular to forming boxes.

2. Related Art

Case forming is one of the production phases in the packaging industry. Corrugated boxes are shipped from the manufacturer in a flat shape, after being cut and glued. This flat shape is very convenient for shipping and handling at high volume, but it is not yet adequate for use. Such raw boxes need to be shaped in the form of a box and taped in order to be used as shipping containers.

Case formers are used to form the corrugated material into box shape. Generally, they require initial adjustments to the size of the box; the width and the length of the box are critical dimensions and need to be manually adjusted carefully on case formers. However, adjustment is a time consuming process, and in the case of a flexible logistics line with variable box sizes, re-adjustment is a major impediment and a source of inefficiency.

SUMMARY

A random case former accepts an opened-up flat corrugated or other material representing an unformed box with open bottom and top flaps. The random case former automatically adjusts to the dimensions of the box by closing in on the unformed box with flap folders from one or more sides. As the flap folders close in on the box, they first fold the minor-flaps and then the major-flaps on the bottom of the unformed box, thereby forming a box with a closed bottom and an open top into which items can then be placed. The automatic adjustment of the random case former to the box size avoids time-consuming manual adjustment and provides efficiency and speed.

BRIEF DESCRIPTION OF DRAWINGS

The invention is described by way of example only, with reference to the accompanying drawings, in which.

DETAILED DESCRIPTION

In the following description, for purposes of explanation, numerous specific details are set forth in order to provide a thorough understanding of the invention. It will be apparent, however, to one skilled in the art that the invention can be practiced without these specific details.

Reference in this specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

In the packaging industry, corrugated materials are cut, glued and shipped in flat form from the manufacturer to a packaging location where they are shaped into boxes and subsequently taped or otherwise sealed in order to be used as shipping containers. In a flexible logistics line with variable box sizes, corrugated materials of various dimensions can be used to prepare correspondingly sized boxes, thereby accommodating shipments of various sizes.

The embodiments of the present invention disclose techniques and apparatus (hereinafter referred to as random case formers) for shaping corrugated materials or other materials of various dimensions comprising walls and bottom and top flaps, into boxes of corresponding dimensions, wherein the random case former, as part of its operation cycle, automatically adjusts to the dimensions of the corrugated material. Advantageously, this frees an operator from having to make careful adjustments to apparatus dimensions whenever the material currently being shaped has dimensions that differ from the dimensions of the material that was previously being shaped by the apparatus. This saves time and increases efficiency.

To shape a flat unformed box with open top and bottom into a formed box with closed bottom according to the embodiments of the present invention, an operator opens up the flat unformed box so that its side walls are at approximately right angles to each other. The operator then pushes the unformed box into a random case former, as disclosed herein, and activates the random case former. The random case former adjusts to the dimensions of the box by closing in on the unformed box from one or more sides. As the random case former adjusts to the dimensions of the box, it folds the minor-flaps and major-flaps on the bottom of the unformed box, thereby forming a box with a closed bottom and an open top into which items can then be placed.

Figure 1:
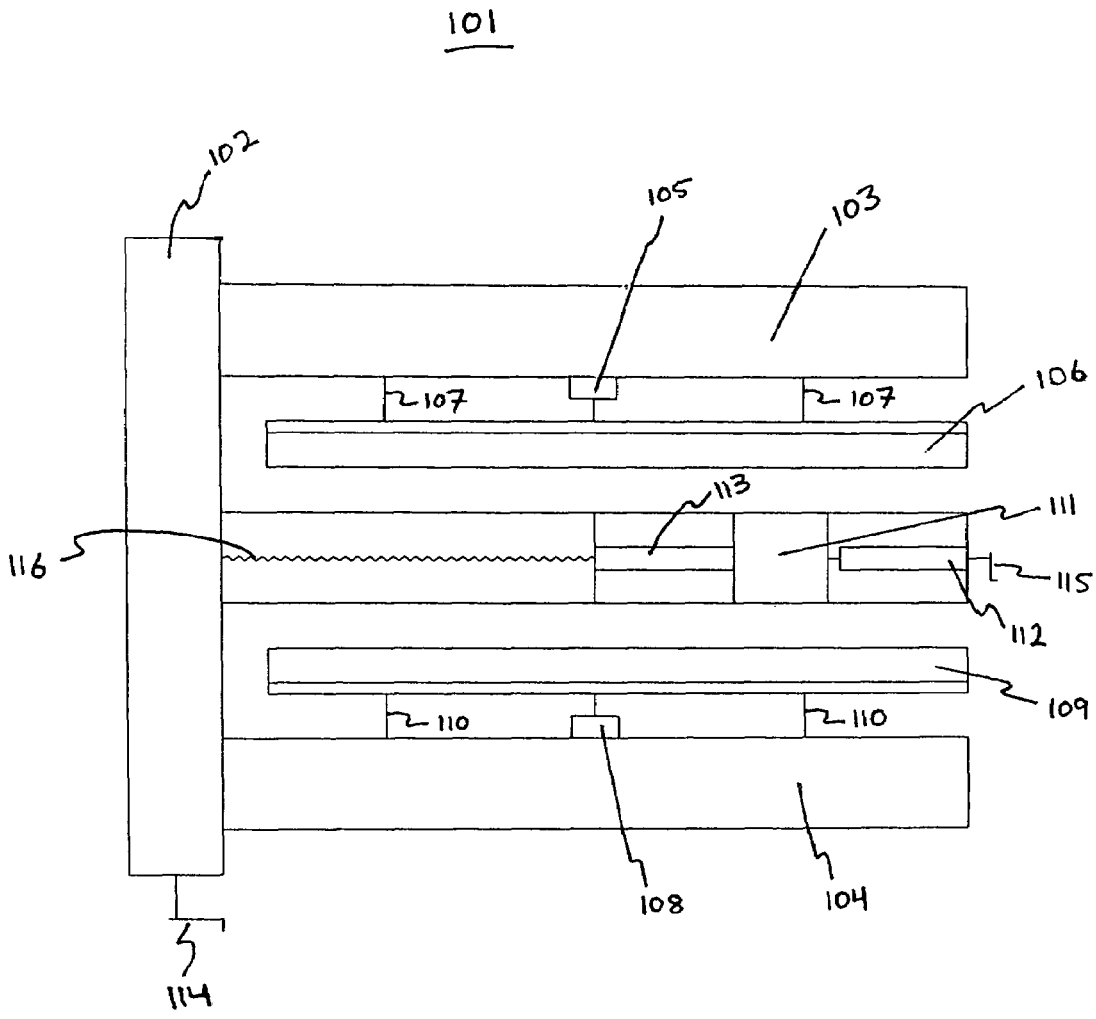
FIG. 1 is a diagrammatic top view of a random case former 101, in accordance with an embodiment of the present invention.

FIG. 1 is a diagrammatic top view of a random case former 101, in accordance with an embodiment of the present invention. The random case former 101 comprises a front 102, a left side 103 and a right side 104. The random case former 101 further comprises a left major-flap folder 106, a right major-flap folder 109 and a minor-flap folder rear unit 111.

The left side 103 comprises a left pusher 105 which is connected to the left major-flap folder 106. The left pusher 105 is capable of pushing the left major-flap folder 106 away from the left side 103 as well as pulling the left major-flap folder 106 towards the left side 103. The left side 103 supports one or more linear bearings 107 which guide the left major-flap folder 106 in its movement as it is pushed or pulled.

The right side 104 comprises a right pusher 108 which is connected to the right major-flap folder 109. The right pusher 108 is capable of pushing the right major-flap to folder 109 away from the right side 104 as well as pulling the right major-flap folder 109 towards the right side 104. The right side 104 supports one or more linear bearings 110 which guide the right major-flap folder 109 in its movement as it is pushed or pulled.

The random case former 101 further comprises a rear pusher 112 to push the minor-flap folder rear unit 111 towards the front 102 and pull the minor-flap folder rear unit 111 away from the front 102. A slide guide 113 underneath the minor-flap folder rear unit 111 serves as a movement guide for the minor-flap folder rear unit 111 as it is pushed or pulled by the rear pusher 112.

In one embodiment, the width of the random case former 101 can be adjusted with the help of a manual width adjuster 114, and the length can be adjusted with the help of a manual length adjuster 115 using a lead screw 116. Adjusting the width or length sets the range of box sizes that can be formed by the random case former 101. Alternatively, the width or length of the random case former 101 may be adjusted with a motorized adjuster. The strokes of the left, right and rear pushers 105, 108 and 112 indicate the working range for the random case former 101. In one embodiment, the strokes of the left, right and rear pushers 105, 108 and 112 are adjustable.

The space delineated on the four sides by the front 102, the left major-flap folder 106, the minor-flap folder rear unit 111 and the right major-flap folder 109 is the space into which an operator pushed down an unformed box, holding it there to be formed by the random case former 101 into a box with a closed bottom and open top. The unformed to box is held such that the major-flaps on the bottom of the unformed box face the left and right major-flap folders 106 and 109, and the minor-flaps face the front 102 and the minor-flap folder rear unit 111. Once an unformed box 117 is held in place, the operator activates the random case former 101. A foot switch, a limit switch, or any other type of switch, initiates the operation of the random case former. The actions of the pushers 105, 112 and 106 allow the random case former 101 to adjust to the dimensions of the unformed box placed within it and to fold its bottom minor-flaps and major-flaps to form a box.

When activated, the random case former 101 first moves the minor-flap folder rear unit 111 towards the unformed box 117 (first case forming cycle), and then moves the left and right major-flap folders 106 and 109 towards the unformed box 117 (second case forming cycle).

Figure 1A:
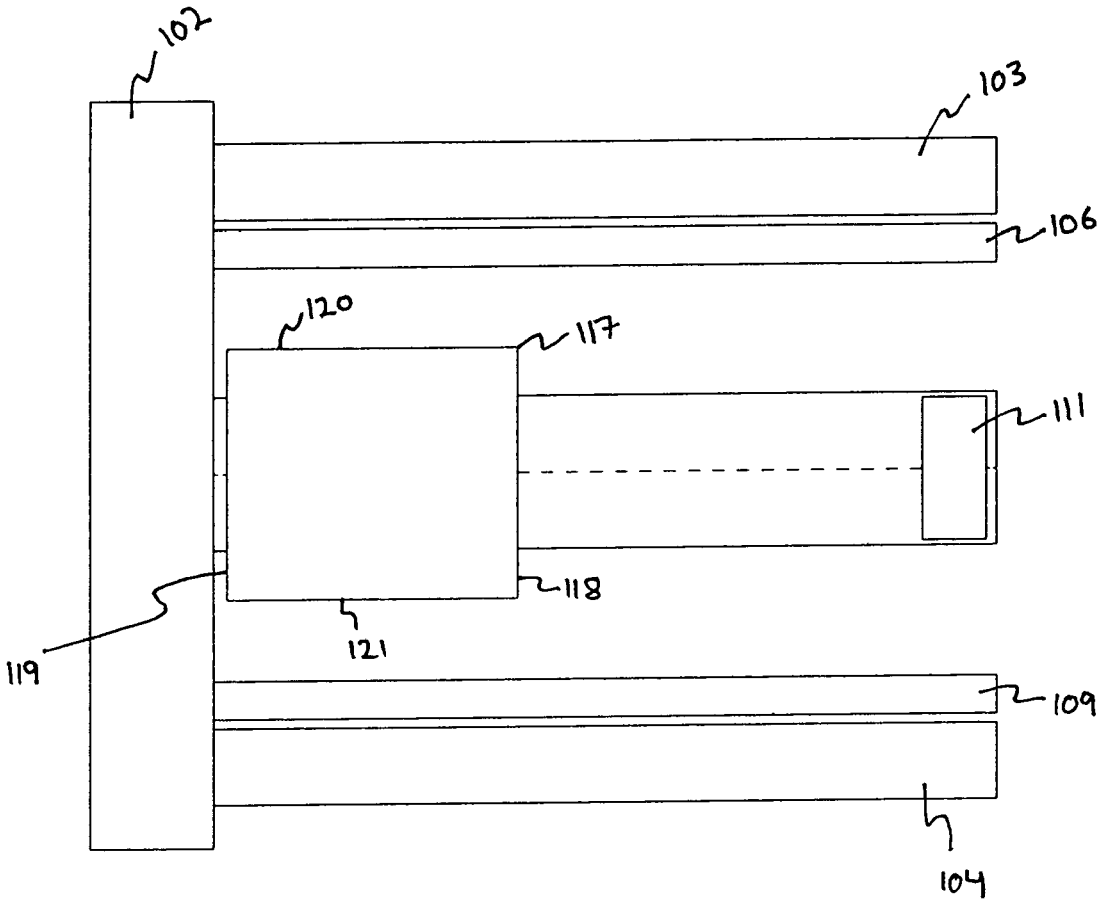
FIGS. 1A, 1B and 1C show a sequence of diagrammatic top views illustrating movements of the minor-flap folder rear unit 111 and the left and right major-flap folders 106 and 109 towards the unformed box 117, in accordance with an embodiment of the present invention.
Figure 1B:
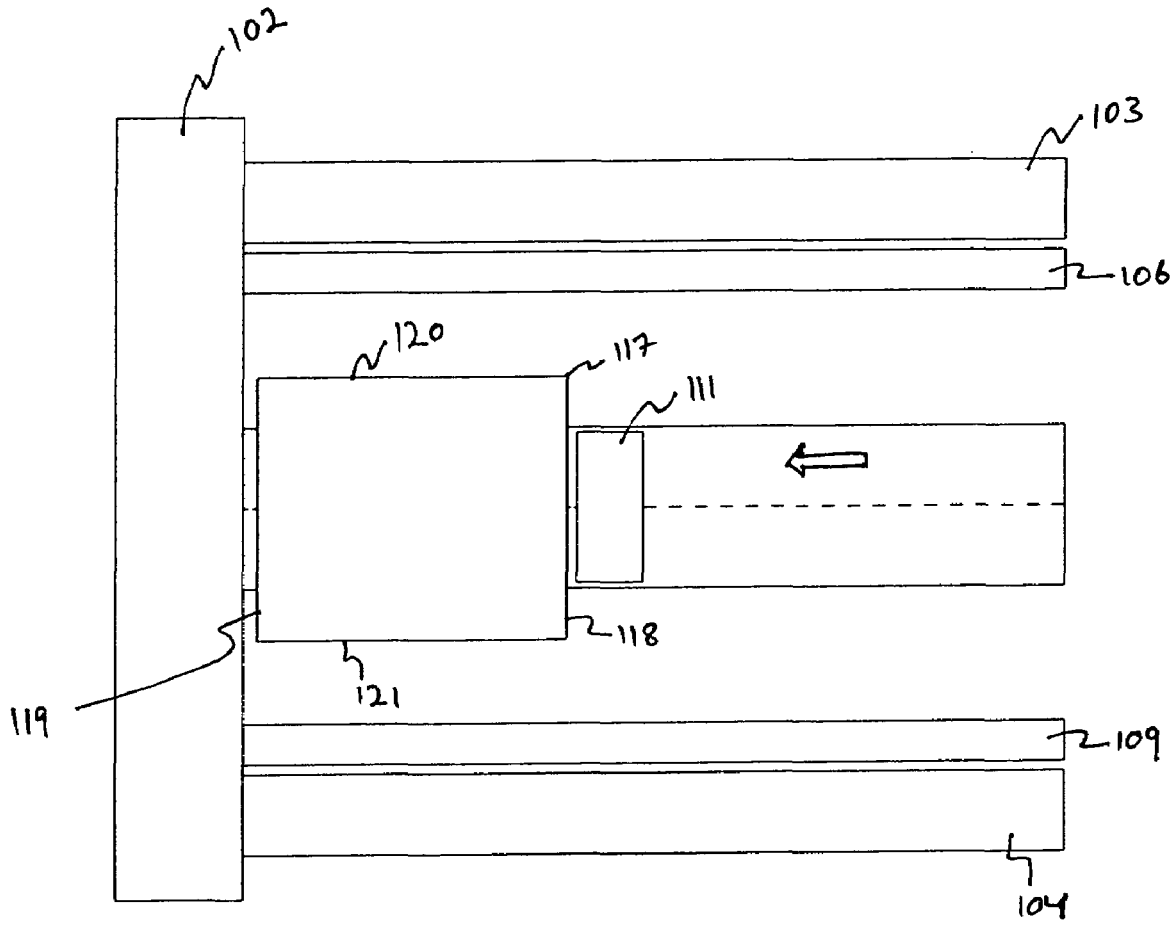
Figure 1C:
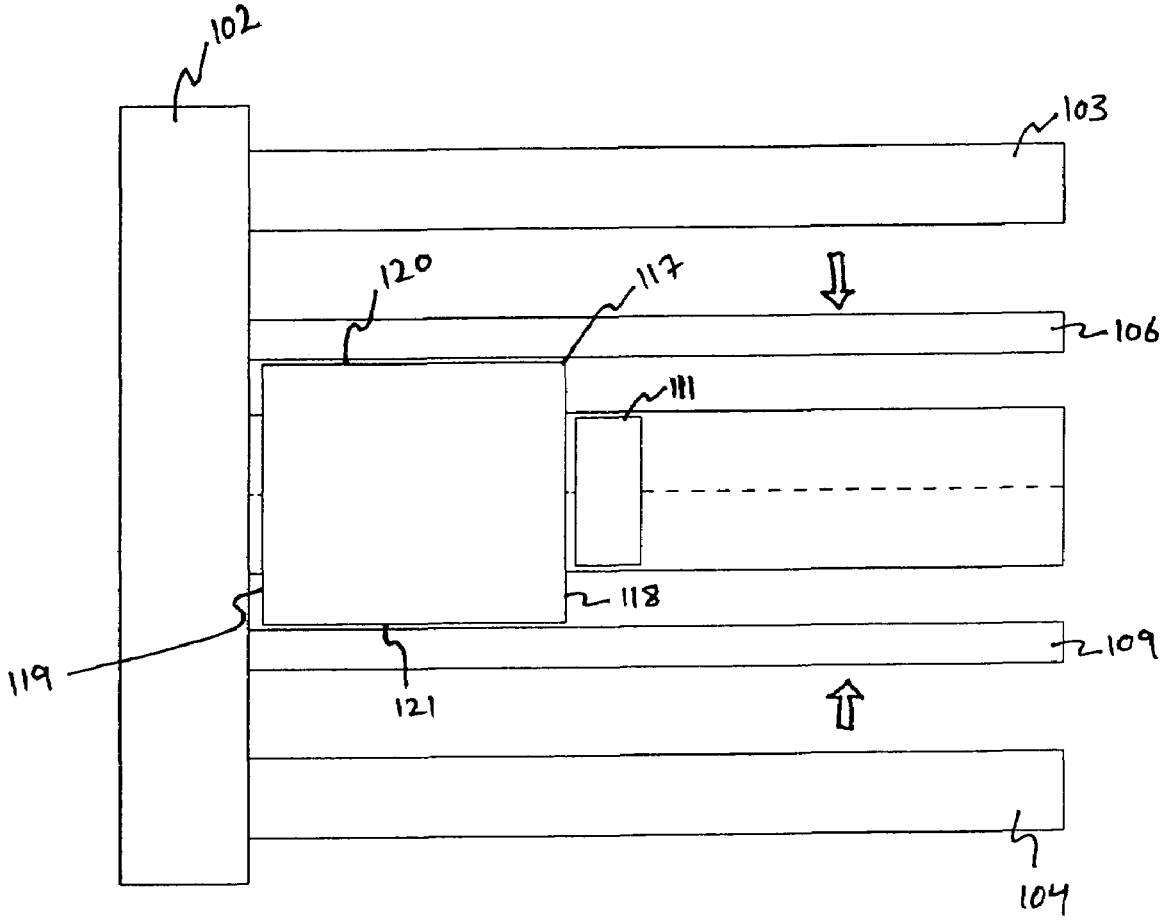

FIGS. 1A, 1B and 1C show a sequence of diagrammatic top views illustrating movements of the minor-flap folder rear unit 111 and the left and right major-flap folders 106 and 109 towards the unformed box 117, in accordance with an embodiment of the present invention. In one embodiment, the sequence of movements is coordinated by limit switches which sense the completion of one movement and initiate the next movement in the sequence. For clarity of illustration, pushers 105, 108 and 112, linear bearings 107 and 110, slide guide 113, lead screw 116 and other items are not shown in FIGS. 1A, 1B and 1C.

In FIG. 1A, an unformed box 117 is shown held in a space provided by the random case former 101, in accordance with an embodiment of the present invention FIG. 1A shows the rear wall 118, front wall 119, left wall 120 and right wall 121 of the unformed box 117. Since FIG. 1A is a diagrammatic top view, the bottom of the box 117 points into the plane of illustration and the top of the box 117 points out of the plane of illustration towards the viewer. Since the minor and major flaps on the bottom of the unformed box 117 are not yet folded, they also point into the illustration sheet.

FIG. 1B shows the minor-flap folder rear unit 111 at the end of the first case forming cycle, after it has moved towards the unformed box 117, in accordance with an embodiment of the present invention. As disclosed below, as the minor-flap folder rear unit 111 moves towards the unformed box 117, it folds the minor-flap on the rear wall 118 of the bottom of the box 117, and a mechanism on the front 102 of the random case former 101 folds the minor-flap on the front wall 119 of the bottom of the box 117.

FIG. 1C shows the left and right major-flap folders 106 and 109 at the end of the second case forming cycle, after they have moved towards the unformed box 117, in accordance with an embodiment of the present invention. As disclosed below, as the left and right major-flap folders 106 and 109 move towards the unformed box 117, they fold the major-flaps on the left wall 120 and right wall 121 of the bottom of the box.

Figure 2:
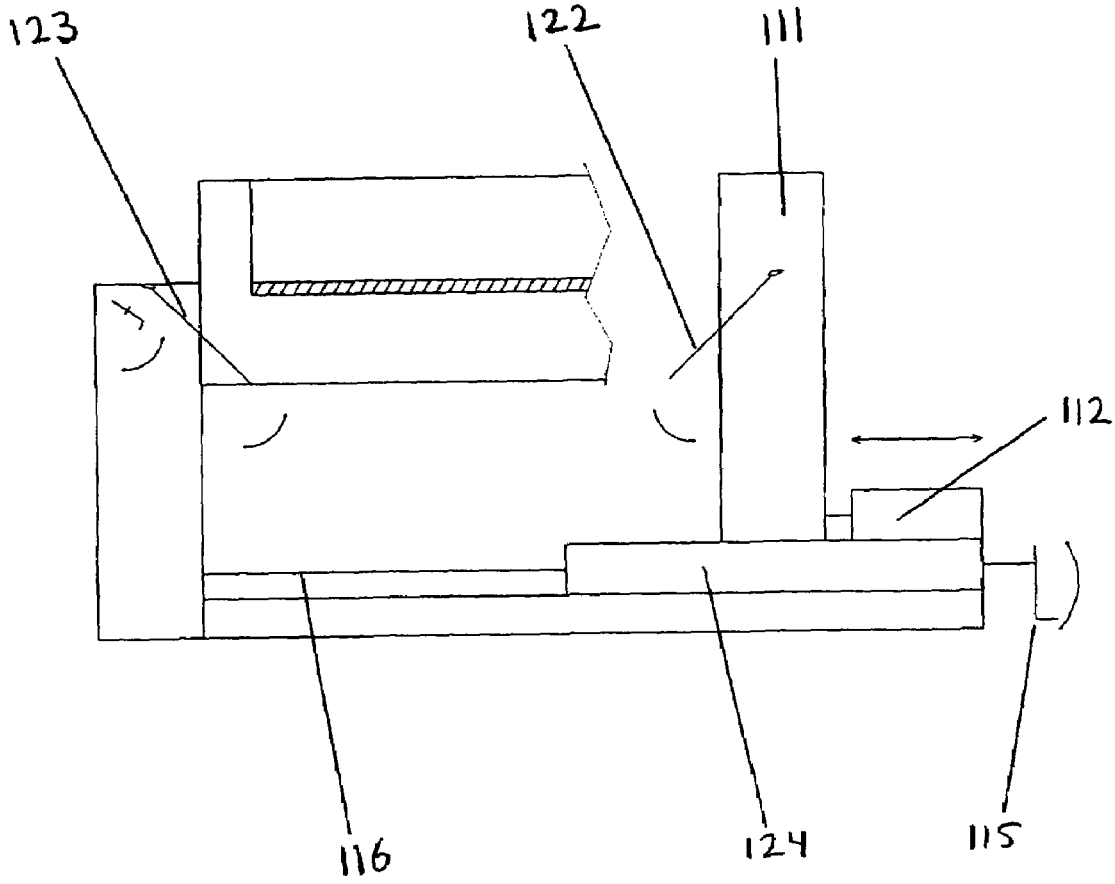
FIG. 2 shows a diagrammatic side cross-section view of a random case former 101, in accordance with an embodiment of the present invention.

FIG. 2 shows a diagrammatic side cross-section view of a random case former 101, in accordance with an embodiment of the present invention. The minor-flap folder rear unit 111 comprises a rear minor-flap folder 122, and the front 102 comprises a front minor-flap folder 123, which are actuated when the minor-flap folder rear unit 111 reaches the end of its movement towards the box 117 at the end of the first case forming cycles. As the rear and front folders 122 and 123 are actuated, they lift up and fold inward the rear and front minor-flaps on the bottom of box 117. In one embodiment, the left and right major-flap folders 106 and 109 close in evenly on the unformed box 117 so as to keep the minor flap-folders 122 and 123 centered with respect to the box 117.

In one embodiment, the actuation of the rear and front folders 122 and 123 is triggered by one or more switches which sense when the minor-flap folder rear unit 111 comes in contact with the box 117. Such switches may also reduce the force that pushes the minor-flap folder rear unit 111 towards the box 117. Such switches may comprise limit switches (such as ones using air valves), or other types of switches as should be obvious to one of ordinary skill in the art.

In one embodiment, the rear and front minor-flap folders 122 and 123 and the left and right pushers 105 and 108 are powered by air pressure, for example using air cylinders. In one embodiment, the force of the folders 122 and 123 and/or the pushers 105 and 108 is stopped or reduced at the end of their respective case forming cycles by using limit switches or by properly adjusting the air pressure. Limit switches may be triggered by the positions of the folders 122 or 123, by the positions or the pivot angles (as disclosed below) of the major-flap folders 105 or 108, or by other positions of the disclosed elements.

Alternatively, as should be obvious to one or ordinary skill in the art, the to folders 122 and 123 and/or the pushers 105 and 108 may be powered by electrical energy or any other type of energy. FIG. 2 also shows a minor carriage assembly 124 which can be pre-set for a certain length range of boxes with the help of the manual length adjuster 115 and lead screw 116, as mentioned above.

Figure 3:
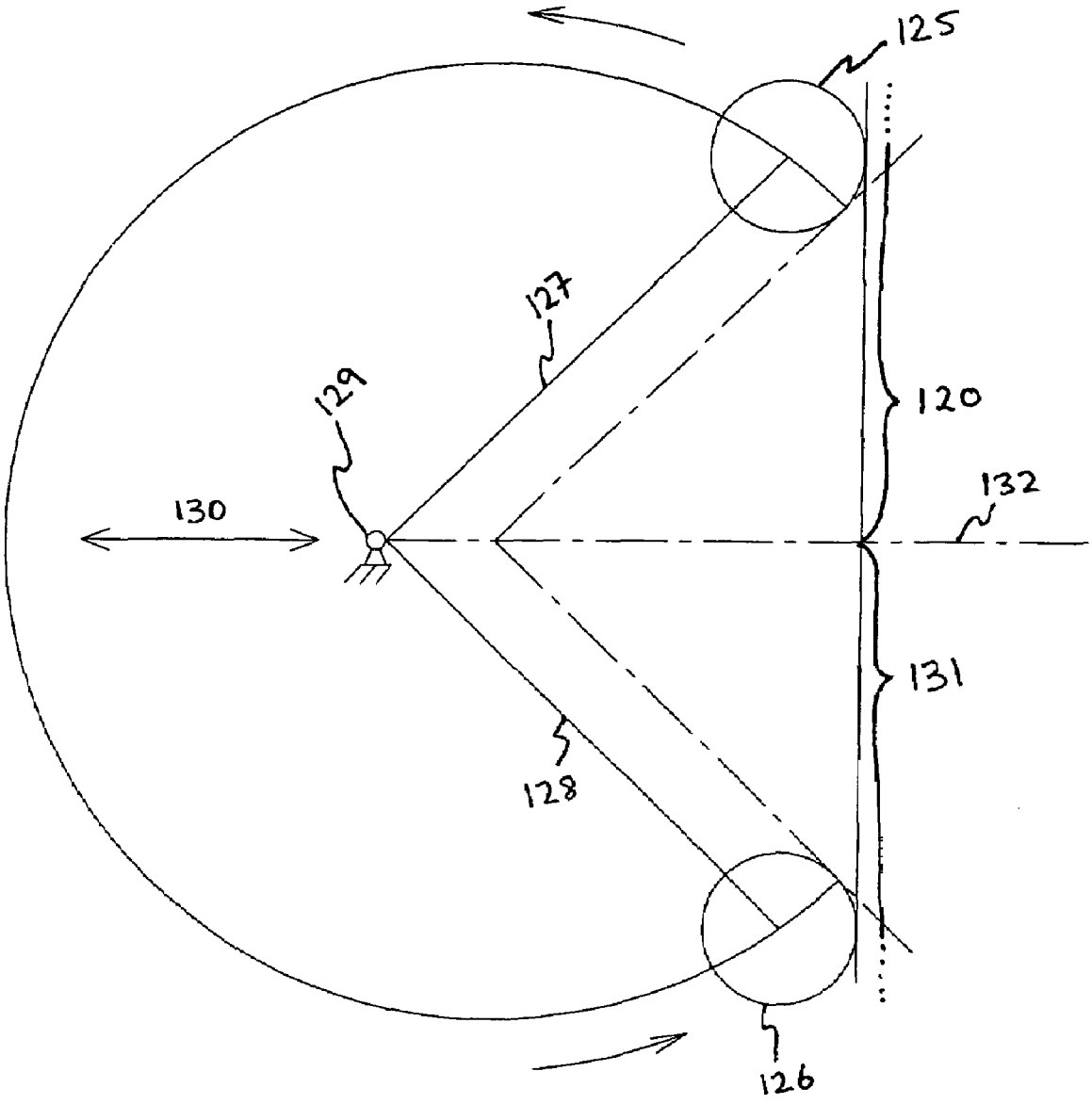
FIG. 3 is a diagrammatic side cross-section view of the major-flap folder 106 in initial position, in accordance with an embodiment of the present invention.

FIG. 3 is a diagrammatic side cross-section view of the major-flap folder 106 (and the identical right major-flap folder 109, not shown separately) in initial position, in accordance with an embodiment of the present invention. The left major-flap folder 106 comprises a pivoting mechanism to hold the left wall 120 of an unformed box 117 and fold the left major-flap 130 on the left wall 120 of the bottom of the unformed box 117. The broken line 131 in FIG. 3 marks where the bottom of the box will be once the major-flaps (and the minor-flaps) are folded and the bottom of the box is formed.

The major-flap folder 106 comprises rollers 125 and 126 held by arms 127 and 128 (at a substantially right angle) pivoting around a pivot point 129. As the left pusher 105 pushes the left major-flap folder 106 towards the unformed box 117 during the second case forming cycle, the left major-flap folder 106 travels longitudinally along the path marked 130 until roller 125 comes in contact with the left wall 120 of the unformed box 117. At that point, the left major-flap folder 106 pivots around the pivot point 129 (counter-clockwise as shown in FIG. 3) as the roller 125 rolls upward along the left wall 120 of the unformed box 117 and the roller 126 applies a force against the left major-flap 131 and folds it inwards.

The second case forming cycle ends when the left major-flap folder 106 is sufficiently pivoted around the pivot point 129 such that the left major-flap 131 is folded to form a substantially right angle with the left wall 120 of the box 117. The movement and operation of the right major-flap folder 109 symmetrically mirrors the left major-flap folder 106, such that at the end of the second case forming cycle both the left and the right major-flaps of the bottom of box 117 are folded (over the already folded rear and front minor-flaps) and the box has a formed bottom and is ready for further handling, such as placement of items therein and/or for further handling (such as taping or sealing the bottom of the box).

In one embodiment, the major-flap folders 106 and 109 are spring loaded to prevent them from pivoting downwards from their original position. In another embodiment, the spring tension is adjustable, thereby allowing an adjustment of the force with which the rollers 125 hold and press on the box 117. In another embodiment, the angle between arms 127 and 128 is less or more than a right angle, thereby allowing the pivot point 125 to be at a height that is above or below the line 132, and further allowing the roller 125 to travel farther or shorter up along the wall of the box as the major-flap is being folded inward.

Figure 3A:
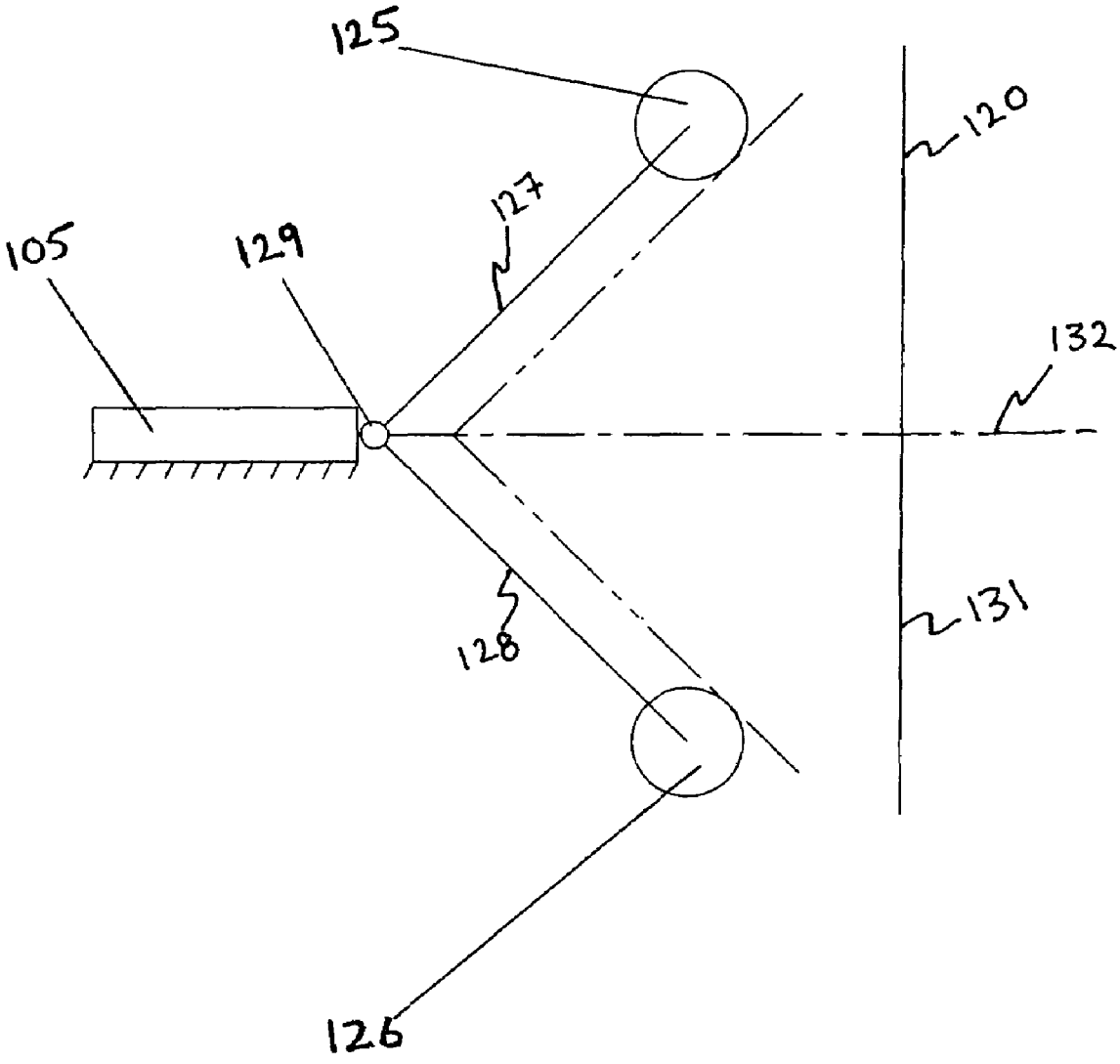
FIGS. 3A, 3B and 3C show a sequence of diagrammatic side cross-section views of the left major-flap folder 106 as it is pushed towards the box and pivots upwards and folds the left major-flap 131, in accordance with an embodiment of the present invention.
Figure 3B:
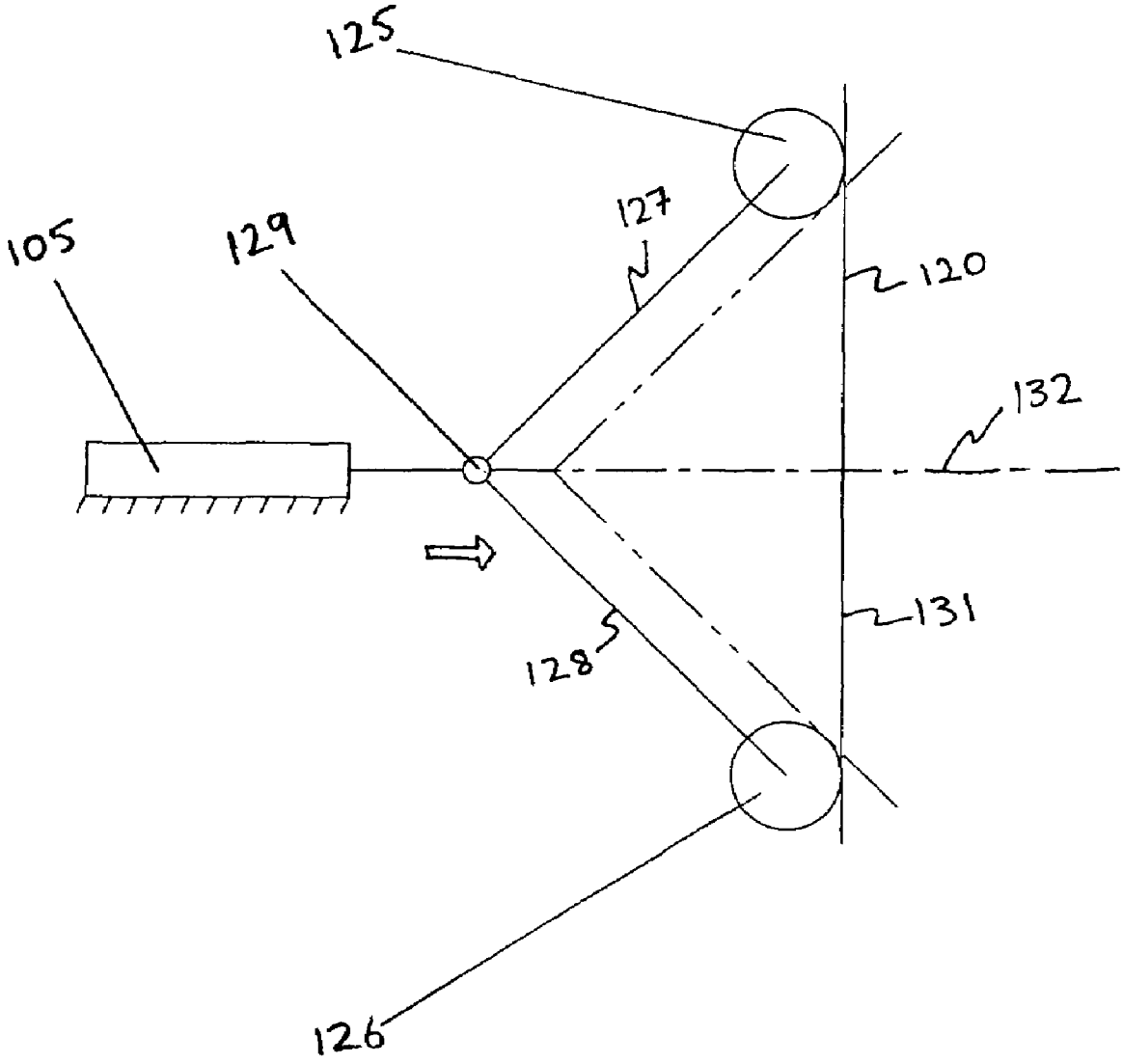
Figure 3C:
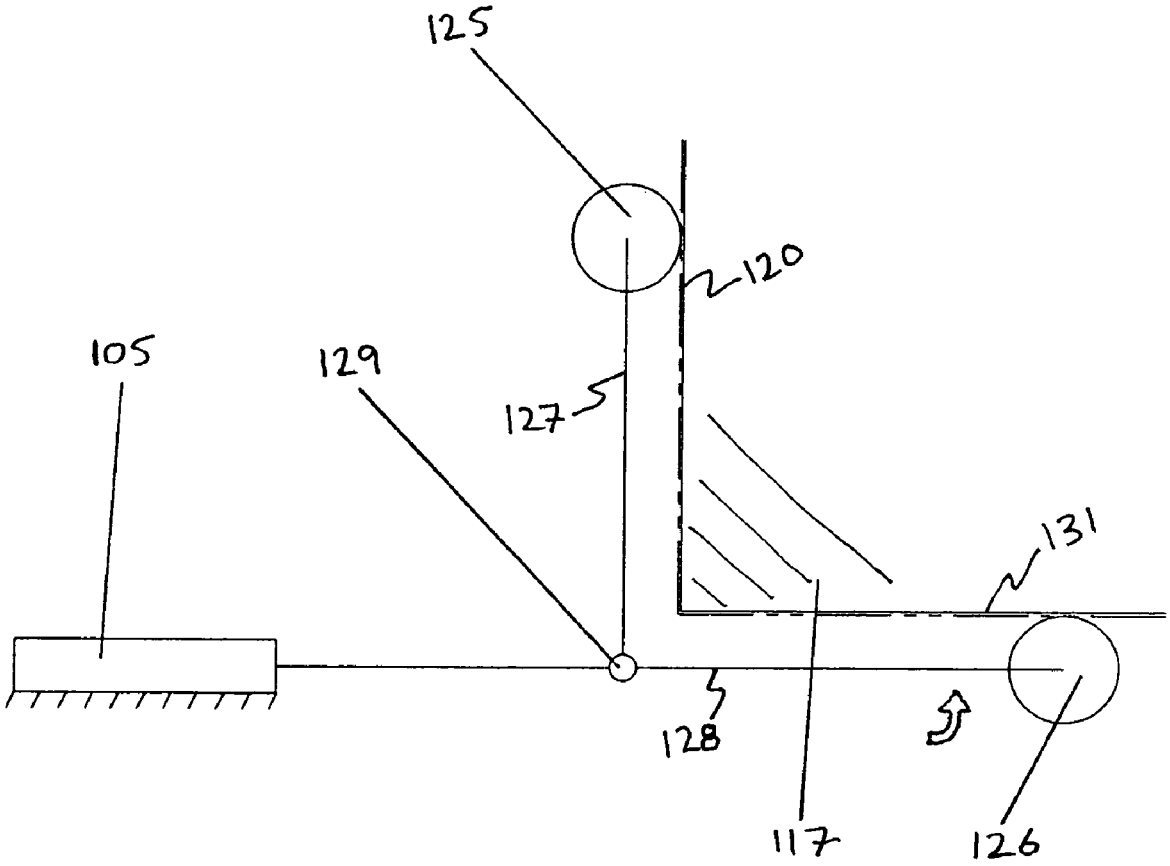

FIGS. 3A, 3B and 3C show a sequence of diagrammatic side cross-section views of the left major-flap folder 106 (and the identical right major-flap folder 109, not shown separately) as it is pushed towards the box and pivots upwards and folds the left major-flap 131 inward, in accordance with an embodiment of the present invention. FIG. 3A shows the left pusher 105 pushing the left major-flap folder 106 towards the left wall 120 of the unformed box 117. FIG. 3B shows the left major-flap folder 106 as it comes in contact with the left wall 120 of the box and the left major-flap 131. FIG. 3C shows the left major-flap folder 106 at the end of the second case forming cycle, with the left major-flap 131 folded inward.

Figure 3D:
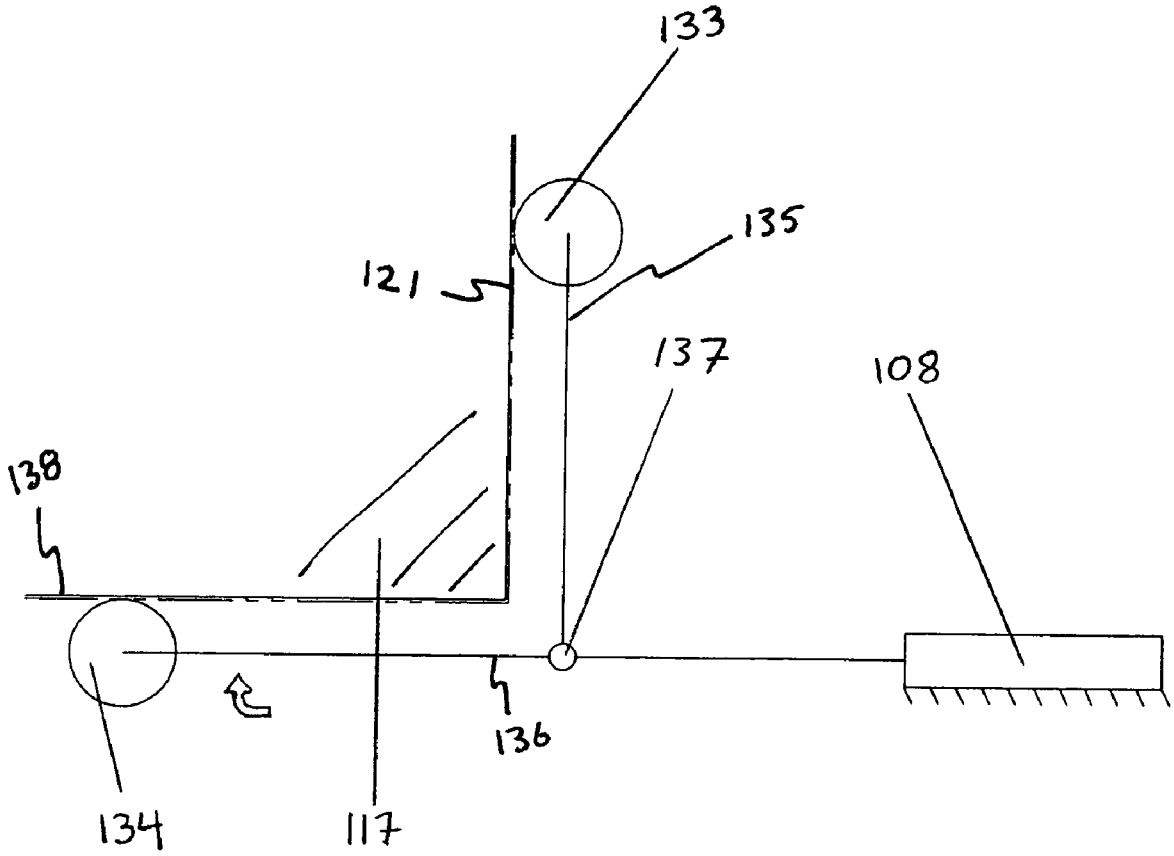
FIG. 3D shows the symmetrically mirrored right major-flap folder 109, in accordance with an embodiment of the present invention.

FIG. 3D shows the symmetrically mirrored but otherwise identical right major-flap folder 109 pushed by right pusher 108 to the end of the second case forming cycle, with rollers 133 and 134 held by arms 135 and 136 (at a substantially right angle) pivoting around a pivot point 137, and with roller 133 holding the right wall 121 of the box 117 and roller 134 folding inward a right major-flap 138 of the box 117, in accordance with an embodiment of the present invention.

At the end of the second case forming cycle, the major-flap folders 106 and 109 and the minor-flap folders 122 and 123 hold the walks and the bottom of the formed box 117. The minor-flap folder rear unit 111 may apply additional force to the bottom of the box. These contribute to making the loading of the box possible directly inside the random case former 101.

Figure 4:
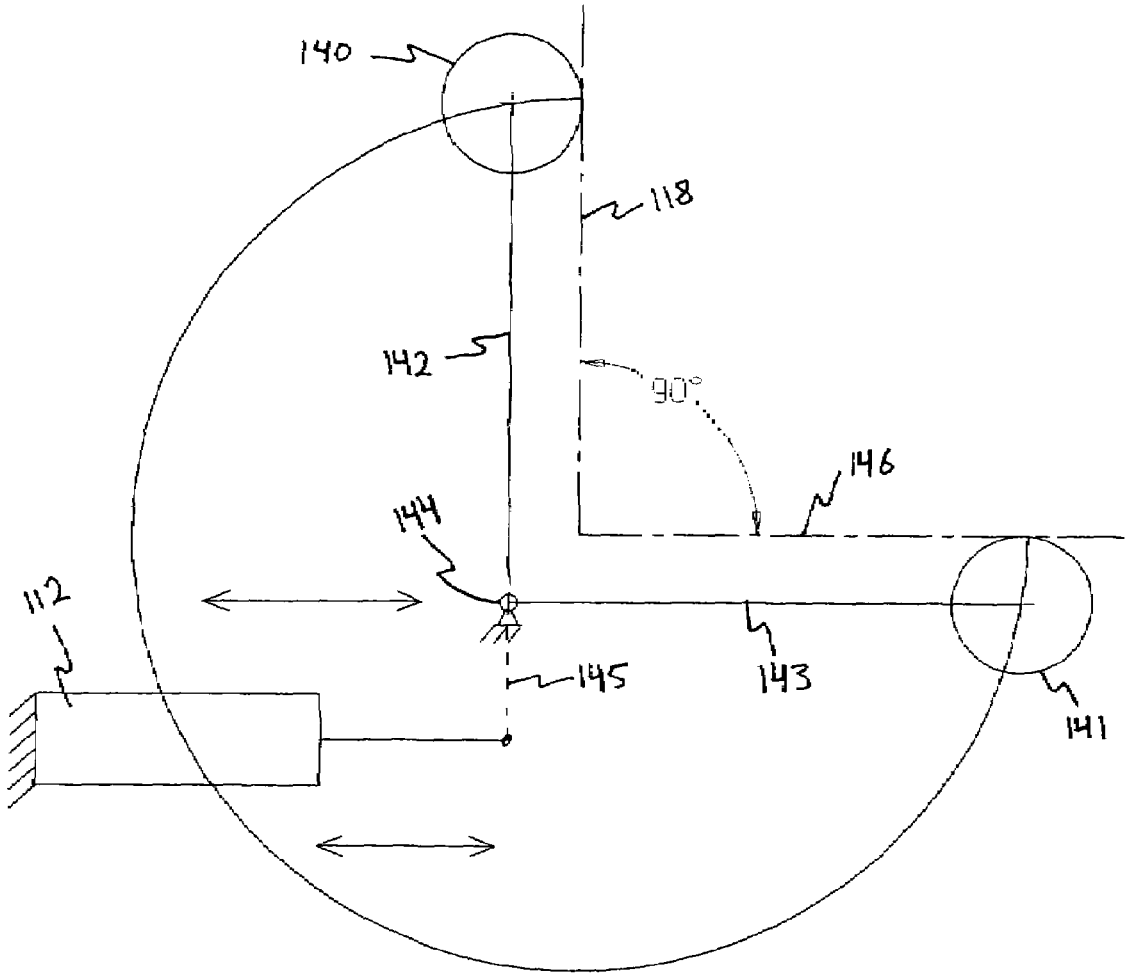
FIG. 4 is a diagrammatic illustration of a rear minor-flap folder 122 comprising a pivoting mechanism similar to the one used for the left and right major-flap folders 106 and 109, in accordance with an embodiment of the present invention.

In an alternative embodiment, the rear minor-flap folder 122 comprises a pivoting mechanism similar to the one used for the left and right major-flap folders 106 and 109 FIG. 4 is a diagrammatic illustration of such an alternative, in accordance with an embodiment of the present invention. In this embodiment, the minor-flap folder rear unit 111 comprises such a pivoting mechanism instead of the rear minor-flap folder 122 described above. Rollers 140 and 141 are held by arms 142 and 143 (at a substantially right angle) pivoting around a pivot point 144. The rear pusher 112 provides the force for pushing or pulling the pivoting structure towards or away from the box 117. As the roller 140 comes in contact with the rear wall 118 of the unformed box 117 and rolls up along the rear wall 118, the pivoting mechanism pivots upwards around the pivot point 144 and the roller 141 applies a force against the rear minor-flap 146 of the bottom of box 117 and folds it inwards. The pivoting mechanism is preferably narrow enough so as to not interfere with the operation of the left and right major-flap folders 106 and 109. The broken line 145 in FIG. 4 represents any intervening structures between the rear pusher 112 and the pivot point 144 which are not shown in FIG. 4, such as the minor-flap folder rear unit 111.

In another alternative embodiment, the front minor-flap folder 123 comprises a pivoting mechanism similar to the one just described for the rear minor-flap folder 123.

In one embodiment, the top of the minor-flap folders 122 and 123 are aligned with the top of the front 102 of the random case former 101, thereby allowing an operator or an automatic mechanism to slide the formed box 117 across the front 102 and out of the random case former 101, and into another station such as a taping or sealing station or a shipping or handling stations.

In one embodiment, formed boxes 117 leave the random case former 101 over the front 102 and enter a sealing station, wherein the sealing station automatically adjusts its dimensions the accommodate for the size of the box 117 that is leaving the random case former 101 and entering the sealing station. Optionally, the random case former 101 uses one or more linear motion encoders to determine the current box size (length and width). Optionally, the box size information can be transmitted from the random case former 101 to the sealing station using a communication element for electronic communication or using mechanical or electric coupling of adjuster mechanisms. Advantageously, this saves time that might otherwise be wasted performing adjustments.

In one embodiment, the random case former 101 comprises a counter which keeps track of the number of boxes of different sizes that are formed. The counter may be programmable to generate alerts indicating that a specified number of boxes of a specified size have been formed, that the number of formed boxes of a specified size in a specified period of time has fallen below a threshold, or generate any other alert or communication based on any user defined logic and/or access to a database.

In one embodiment, the random case former 101 can be locked into a particular box size, thereby avoiding unnecessary wear and tear for a period of time during which it is known that only boxes of the specified size are to be formed.

In one embodiment, the random case former 101 comprises only one pusher (105 or 108) for a major-flap folder, with the other major-flap folder remaining stationary. In such an embodiment, the unformed box 117 would be placed next to the stationary major-flap folder so that the other major-flap folder can close in on the box 177. This saves some cost and allows for a cheaper random case former 101.

While certain exemplary embodiments have been described and shown in the accompanying, drawings, it is to be understood that such embodiments are merely illustrative and not restrictive of the broad invention and that this invention is not limited to the specific constructions and arrangements shown and described, since various other modifications may occur to those ordinarily skilled in the art upon studying this disclosure. In an area of technology such as this, where growth is fast and further advancements are not easily foreseen, the disclosed embodiments may be readily modifiable in arrangement and detail as facilitated by enabling technological advancements without departing from the principals of the present disclosure or the scope of the accompanying claims.

What is claimed is:

1. An apparatus, comprising:

a first and second minor-flap folder to fold inward a first and second minor-flap on a bottom of a box, wherein the second minor-flap folder remains stationary while the first minor-flap folder moves towards the box until it comes in contact with the box and stops, thereby adjusting to a length of the box, after which the first and second minor-flap folders pivot upward and fold the first and second minor-flaps of the box;

a first and second major-flap folder to fold inward a first and second major-flap on the bottom of the box after the first and second minor-flaps are folded, wherein the first and second major-flap folders move towards the box until they come in contact with the box and stop, thereby adjusting to a width of the box, after which the first and second major-flap folders pivot upward and fold the first and second major-flaps of the box;

wherein the first minor-flap folder and the first and second major-flap folders pull back to their original positions when the box is removed from the apparatus, thereby allowing the apparatus to automatically adjust to length and width of boxes placed within it; and the first major-flap folder comprising a first and second roller held by a first and second arm pivoting around a first pivot point, the first roller to come in contact with a first box wall and roll upward along the first box wall as the first major-flap folder moves towards the box, the second roller to come in contact with the first major-flap and fold the first major-flap as the first major-flap folder moves towards the box.

2. The apparatus of claim 1, the second major-flap folder comprising a third and fourth roller held by a third and fourth arm pivoting around a second pivot point, the third roller to come in contact with a second box wall and roll upward along the second box wall as the second major-flap folder moves towards the box, the fourth roller to come in contact with the second major-flap and fold the second major-flap as the second major-flap folder moves towards the box.

3. The apparatus of claim 2, wherein the first and second arms are at substantially right angle to each other, and the third and fourth arms are at substantially right angle to each other.

4. The apparatus of claim 2, wherein the pivoting of the first and second minor-flap folders is powered by air pressure.

5. The apparatus of claim 2, the first minor-flap folder comprising a fifth and sixth roller held by a fifth and sixth arm pivoting around a third pivot point, the fifth roller to come in contact with a third box wall and roll upward along the third box wall as the first minor-flap folder moves towards the box, the sixth roller to come in contact with the first minor-flap and fold the first minor-flap as the first minor-flap folder moves towards the box.

6. The apparatus of claim 3, further comprising:

a first actuator to move the first minor-flap folder towards the box and away from the box;

a second actuator to move the first major-flap folder towards the box and away from the box; and a third actuator to move the second major-flap folder towards the box and away from the box.

7. The apparatus of claim 6, wherein the first, second and third actuators are powered by air pressure.

8. The apparatus of claim 6, wherein the first and second minor-flap folders are sufficiently narrow so as to not interfere with the first and second major-flap folders.

9. The apparatus of claim 8, wherein the first and second minor-flap folders are substantially centered with respect to the width of the box, and wherein the first and second major-flap folders move evenly towards the box, thereby allowing the first and second minor-flap folders to remain substantially centered with respect to the width of the box.

10. The apparatus of claim 9, wherein the first and second major-flap folders are spring loaded to prevent them from pivoting downwards.

11. The apparatus of claim 10, wherein a spring tension of the first and second major-folders is adjustable, thereby allowing adjustment of the force with which the first and second major-flap folders hold the box.

12. The apparatus of claim 11, wherein the first and second major-flap folders apply sufficient force to the bottom of the box to allow loading items into the box while the box is in the apparatus.

13. The apparatus of claim 9, wherein the unformed box is placed within the apparatus between the first and second minor-flap folders and the first and second major-flap folders by an operator of the apparatus.

14. The apparatus of claim 9, further comprising:

a counter to keep track of the number of boxes of different sizes formed by the apparatus.

15. The apparatus of claim 9, further comprising:

one or more linear motion encoders to determine the width and length of the box being formed by the apparatus.

16. The apparatus of claim 15, further comprising a communication element for sending the width and length of the box to a sealer station for sealing the bottom of the box, thereby allowing the sealer station to pre-adjust to the width and length of the box.

* * * * *